US005360124A

United States Patent [19]

Wurzer et al.

[11] Patent Number: 5,360,124

[45] Date of Patent: Nov. 1, 1994

[54] SLACKLESS BUFF GEAR CONNECTION SYSTEM WITH SLIDING YOKE CASTING

[75] Inventors: Jeffrey D. Wurzer; Peter S. Mautino, both of Pittsburgh, Pa.

[73] Assignee: McConway & Torley Corporation, Pittsburgh, Pa.

[21] Appl. No.: 97,960

[22] Filed: Jul. 27, 1993

[51] Int. Cl.[5] ..... B61G 9/00

[52] U.S. Cl. ..... 213/62 R; 213/45; 213/50; 213/67 R; 213/75 R

[58] Field of Search ..... 213/45, 46 A, 47, 50, 213/53, 59, 61, 62 R, 64, 67 R, 67 A, 69, 75 R

[56] References Cited

U.S. PATENT DOCUMENTS

| | | | |
|---|---|---|---|
| 3,400,834 | 9/1968 | Zanow | 213/64 |
| 3,716,146 | 2/1973 | Altherr . | |
| 3,722,708 | 3/1973 | Ion et al. . | |
| 3,841,496 | 10/1974 | Hawthorne | 213/62 R X |
| 4,258,628 | 3/1981 | Althers | 213/75 R X |
| 4,456,133 | 6/1984 | Altherr et al. . | |
| 4,531,648 | 7/1985 | Paton | 213/64 X |
| 4,700,853 | 10/1987 | Altherr et al. . | |
| 5,131,548 | 7/1992 | Chi | 213/64 |
| 5,246,135 | 9/1993 | Radwill | 213/62 R X |

FOREIGN PATENT DOCUMENTS

| | | | |
|---|---|---|---|
| 1258258 | 8/1989 | Canada | 213/61 |

OTHER PUBLICATIONS

Drawing Headed: American Steel Foundries–The Good Ride Company No date, 1 page.

*Primary Examiner*—Robert J. Oberleitner
*Assistant Examiner*—S. Joseph Morano
*Attorney, Agent, or Firm*—James Ray & Associates

[57] ABSTRACT

A railway car connection system for a railway car having a center sill. Such connection system includes a sliding yoke. The sliding yoke having a front pocket portion open at a front end thereof. The front pocket portion is formed by a top wall portion, a bottom wall portion and a pair of radially opposed side wall portions which form a continuous outer wall. Such continuous outer wall has an outer cross section complementary to an interior cross section of such center sill and capable of both being received therein and sliding longitudinally thereof. The top wall portion has a first bore therethrough and the bottom wall portion has a second bore therethrough concentric with such first bore. A rear block portion having a top wall portion, a bottom wall portion and side wall portions each adjacent the corresponding top wall portion, bottom wall portion and side wall portions of such front pocket portion. At least the side wall portions of such rear block portion being recessed inwardly toward a longitudinal center line of the sliding yoke from corresponding adjacent portions of such continuous outer wall of the front pocket portion. Such rear block portion has a rear wall surface provided with a bore having its axis along the longitudinal centerline of the front pocket portion. Such bore extending through the rear wall surface of such rear block portion and at least partly through such rear block portion.

20 Claims, 4 Drawing Sheets

SLACKLESS BUFF GEAR CONNECTION SYSTEM WITH SLIDING YOKE CASTING

FIELD OF THE INVENTION

The present invention relates to a slackless connection system for connecting adjacent ends of a pair of railway cars together and especially to such a system which includes a buff gear assembly for helping to eliminate slack and impact loads between the elements of the connection system and specifically to such a system which utilizes a sliding yoke arrangement.

BACKGROUND OF THE INVENTION

It has been known in the railroad industry to connect together adjacent cars in a train by means of a so-called "standard coupler" and in more recent times to connect such adjacent cars together in a substantially semi-permanent manner using drawbars.

It is also known in the railway art to provide draft gear assemblies in a coupling arrangement to absorb at least a portion of the buff and draft forces which are generated and applied to the railroad freight cars during in-track operation of the train consist and to provide slack between cars so that a relatively long train of cars can be started into motion one car at a time.

More recently it has been the practice on railways to eliminate draft gear assemblies and to provide instead slackless systems for connecting adjacent cars by means of couplers or drawbars.

Furthermore, since the introduction of the more powerful diesel locomotive in the modern railroad industry, it has been discovered that the slack formerly required between adjacent cars in the older style coupling arrangements to enable a relatively low powered locomotive to start a train consist in motion one car at a time is no longer required. As a result, slackless coupling and drawbar assemblies have generally come into widespread use in the railroad industry as an arrangement for joining together the adjacent ends of a pair of railway freight cars in a train. It has been demonstrated that these slackless assemblies enable the buff and draft forces which are generated by in-track movement to be distributed through the car center sill member to all of the railway cars making up such train consist with less damage to both the freight car components and cargo.

It has now been found that operation of a slackless connection system can be improved if it is combined with a draft gear apparatus permitting limited longitudinal movement between the connecting pin of a slackless connection system and the center sill of a railway car to which it is connected when the system is under buff load. Such movement can be provided by compression of an elastomeric assembly which can absorb a predetermined level of buff load, established in part by the location of a rigid sill load member.

The elastomeric assembly can be prestressed to absorb a predetermined amount of buff loading before relative motion between the connecting pin and the railway car center sill occurs. The maximum load absorbed by the elastomeric assembly is a function of the initial prestress, the compression characteristics of the elastomer used and the distance through which the connecting pin is allowed to move before the rigid sill load member is contacted.

The connection system so constructed is effective to absorb all or a substantial portion of impact loads occurring during changes from draft to buff loads and reduces the deleterious effects of such loads on railway cars and cargo.

SUMMARY OF THE INVENTION

The present invention provides a connection system for joining adjacent ends of a pair of railway cars each having a center sill with a predetermined interior cross section, such connection system including a sliding yoke and the sliding yoke comprising a front pocket portion open at its front end; a top wall portion forming the top of the front pocket portion; a bottom wall portion forming the bottom of the front pocket portion; a pair of radially opposed side wall portions forming the sides of the front pocket portion; the top wall portion, the bottom wall portion and the side wall portions forming a continuous outer wall of the front pocket portion; the continuous outer wall having an outer cross section generally complementary to the interior cross section of such center sill and capable of being received in a center sill of a railway car on which it is to be used and capable of sliding within such center sill longitudinally thereof; the top wall portion having a first bore therethrough, the bore having a predetermined diameter; the bottom wall portion having a second bore therethrough having a predetermined diameter and concentric with the first bore; a rear block portion having a top wall portion, a bottom wall portion and side wall portions each adjacent to the corresponding top wall portion, bottom wall portion and side wall portions of the front pocket portion and at least the side wall portions of the rear block portion being recessed inwardly toward the longitudinal center line of the sliding yoke casting from the corresponding adjacent portions of the continuous outer wall of the front pocket portion; and the rear block portion having a rear wall surface and being provided with a bore having its axis along the longitudinal centerline of the front pocket portion, the bore extending through the rear wall surface of the rear block portion and at least partly through the rear block portion.

The invention also provides a sliding yoke having a front pocket portion open at its front end, the front pocket portion being formed by a continuous outer wall; the continuous outer wall having an outer cross-section generally complementary to the interior cross section of such center sill and capable of being received in such center sill for sliding movement within such center sill longitudinally thereof; a sill load member comprising at least first and second radially opposed stop members capable of being secured to opposed side walls on the inside of such center sill; the sill load member being effective when secured to the side of a railway car center sill inwardly of the distal end of such center sill and inwardly of the sliding yoke to limit longitudinal movement of the sliding yoke in a direction away from the distal end of such center sill.

The invention further provides a sliding yoke having a front pocket portion open at its front end, the front pocket portion being formed by a continuous outer wall; the continuous outer wall having an outer cross-section generally complementary to the interior cross-section of such center sill and capable of being received in such center sill for sliding movement within such center sill longitudinally thereof; a sill cap adapted to be secured to the open end of a railway car center sill in which a sliding yoke has been placed to thereby limit longitudinal movement of the sliding yoke toward the open end of such railway car center sill.

One end of a coupler shank or of a drawbar is connected to a yoke by means of a connecting pin with the end of the coupler shank or drawbar located in a front pocket portion of the yoke. A follower and slack take up wedge are provided to complete the structure of a slackless connection between the coupler shank or drawbar and the yoke. The yoke can slide longitudinally within the center sill of the railway car within limits established by the location of a pair of sill load members and of a sill cap affixed to the open end of the railway car center sill. An elastomeric buff gear assembly is disposed between the inward side of the sill load members and rear stop members rigidly secured to the center sill of the railway car. Buff loads are transferred from the center sill through the rear stop members to the buff gear assembly, to the sliding yoke and through the connecting pin to the drawbar or coupler shank. The buff gear assembly comprises one or more compressible elastomeric members in a compressively prestressed condition mounted on a support member or rod secured to the sliding yoke.

A predetermined amount of buff force is absorbed in the buff gear assembly by further compression of the elastomeric members between the rear stop and the rear wall of the sliding yoke. Space is provided between the front face of the sill load members and the rear wall of the front pocket portion of the sliding yoke to permit a predetermined amount of compression of the elastomeric members. The initial prestress of the elastomeric members, the compression characteristics of the elastomeric members and the distance the sill load members can move longitudinally before contacting the adjacent rear wall of the front pocket portion determine the maximum amount of buff force which can be absorbed by the buff gear assembly. Buff loads in excess of such maximum are transferred from the sliding yoke directly to the railway car center sill through a sill cap secured to the distal end of the center sill.

OBJECTS OF THE INVENTION

It is one of the objects of this invention to provide an improved slackless connection system which can be readily substituted for a slackless connection system already on a railway car or as a replacement for a conventional AAR coupler and draft gear with a minimum amount of modifications to the center sill or which can be applied as original equipment to any new railway car having a center sill.

Another object of this invention is to provide a slackless coupling system employing a sliding yoke which provides limited movement between the center sill of a car and the pin connecting the coupling to such center sill.

Yet another object of this invention is to provide a slackless coupling system in which buff forces are applied to the center sill of a railway car through a buff gear apparatus to reduce impact loads on a railway car and its contents.

Still another object of this invention is to provide a slackless connection system for a railway car which utilizes an elastomeric buff gear assembly to provide limited longitudinal motion between the end of a coupler shank or drawbar and a railway car center sill to absorb impact loads during changes from draft to buff operation.

Yet another object of this invention is to provide such a system in which the buff gear assembly can be adjusted to control the amount of movement permitted.

It is also an object of this invention to provide a slackless buff gear system having an elastomeric buff gear system which can be prestressed in compression and having a rigid sill load member whose location can be adjusted to control the degree of relative motion permitted between a railway car center sill and a connecting pin through which draft and buff forces occurring during in-train operation of railway cars are applied to the center sill of the railway cars, thereby to control the maximum force which will be absorbed by the buff gear system.

It is another object of this invention to provide a slackless buff gear connection system which is relatively simple in construction and which can be easily applied to a railway car having a center sill.

It is also an object of this invention to provide a slackless buff gear connection system which does not limit the maximum horizontal angling, vertical motion or torsional rotation of the coupler shank or drawbar connecting adjacent railway cars from the angles, movement or torsional rotation permitted by other connecting systems.

These and various additional objects and advantages of the invention will become apparent to persons skilled in the art from the following description of the invention particularly when reviewed in conjunction with the appended drawings and claims.

DESCRIPTION OF THE INVENTION

Figure 1:
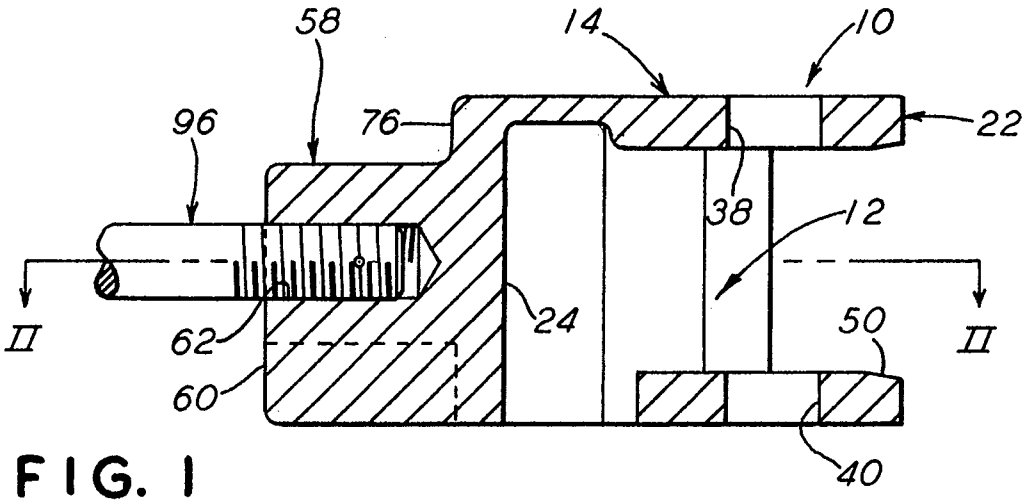
FIG. 1 is a cross sectional view of the sliding yoke of the invention taken along the line of I—I of FIG. 2.

Prior to proceeding to a more detailed description of the various preferred and alternative embodiments of the present invention it should be noted that for the purpose of clarity, identical components which have identical functions have been identified with identical reference numerals throughout the several views illustrated in the drawings.

Figure 2:
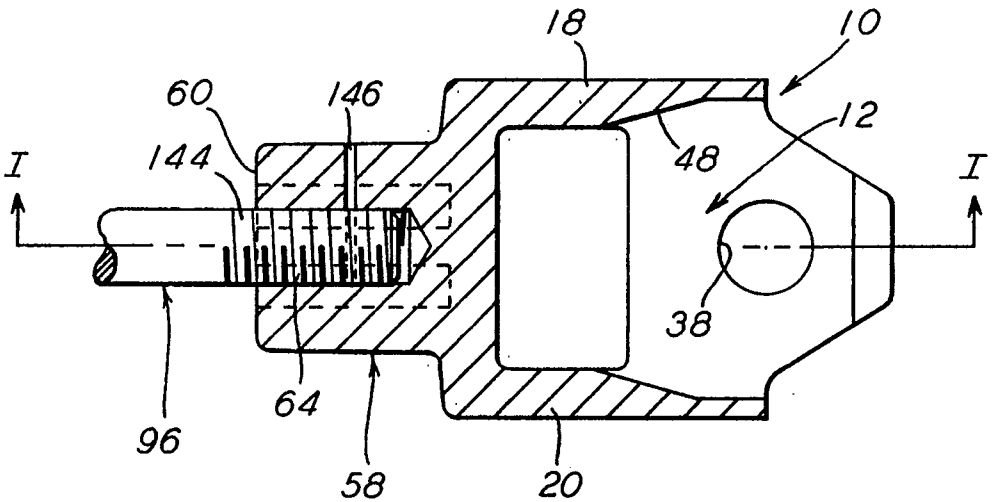
FIG. 2 is a cross sectional view of the sliding yoke of the invention taken along the line II—II of FIG. 1.
Figure 3:
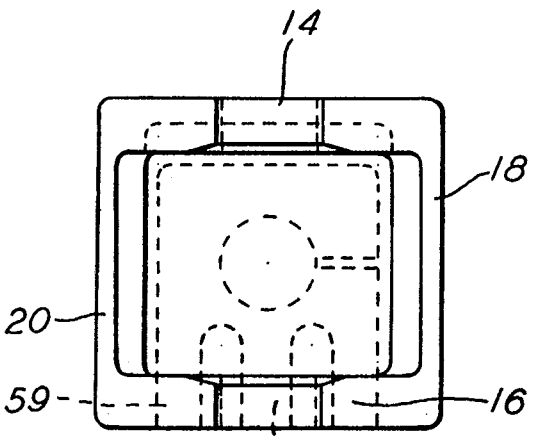
FIG. 3 is a front elevational view of the sliding yoke of the invention.
Figure 10:
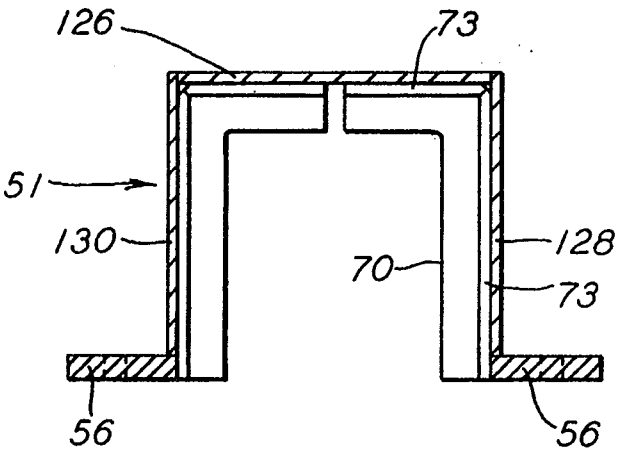
FIG. 10 is a cross-sectional view of a railway car center sill taken along the line X—X in FIG. 9.

Referring now to the drawings, a sliding yoke generally designated 10, is shown in FIGS. 1, 2, and 3. The sliding yoke comprises a front pocket portion 12 comprising a top wall portion 14, a bottom wall portion 16 and a pair of radially opposed side wall portions 18 and 20. The front pocket portion is open at its front end 22 and is closed at its back wall 24.

The top wall portion 14 of the front pocket portion has a bore 38 formed therein having a predetermined diameter and bottom wall portion 16 has a bore 40 having a predetermined diameter and being aligned with and congruous with the bore 38. Bores 38 and 40 are constructed and located to receive opposite ends of a connecting pin 36 used to connect one end of a coupler shank or drawbar to the sliding yoke 10. The connection between the coupler shank or drawbar and the connecting pin 36 includes hemispheric bearing blocks 42 and a bearing block retainer clip 44.

Figure 4:
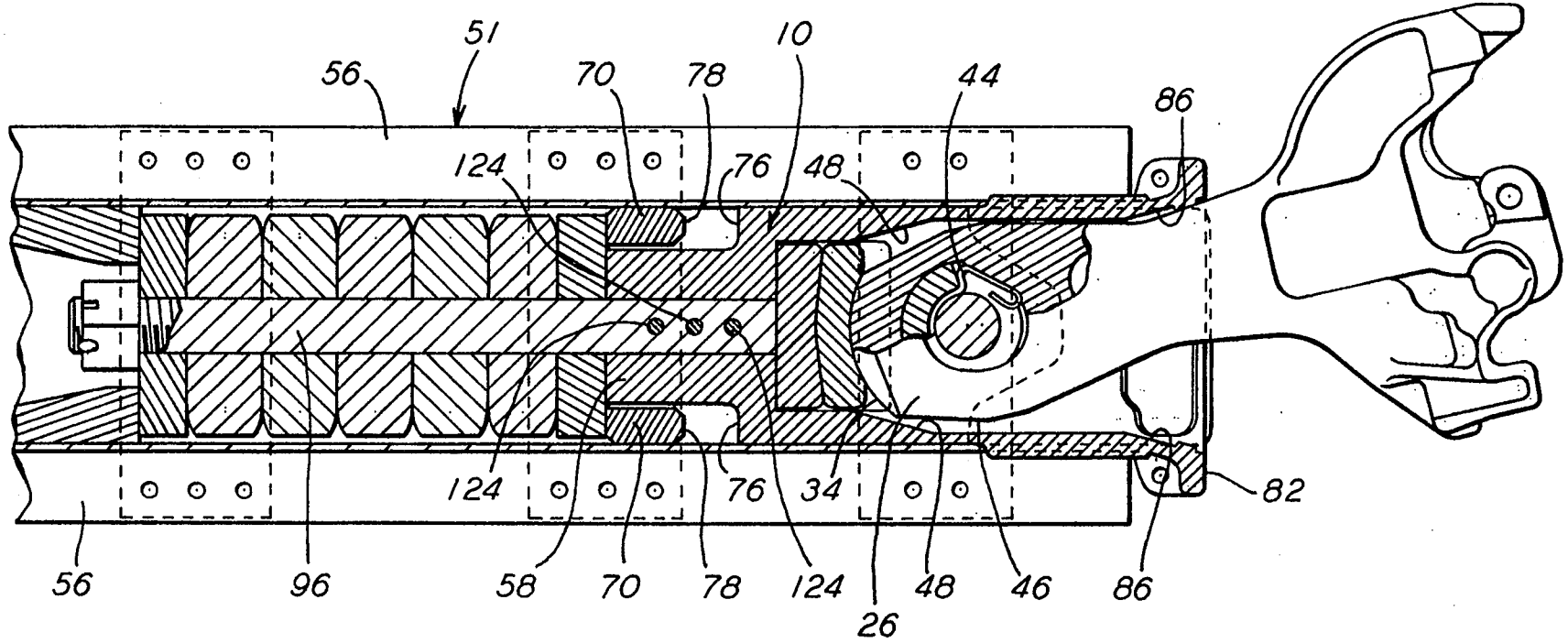
FIG. 4 is a top plan view, partly in cross section, of the slackless buff gear connection system of the invention assembled in the center sill of a railway car.
Figure 5:
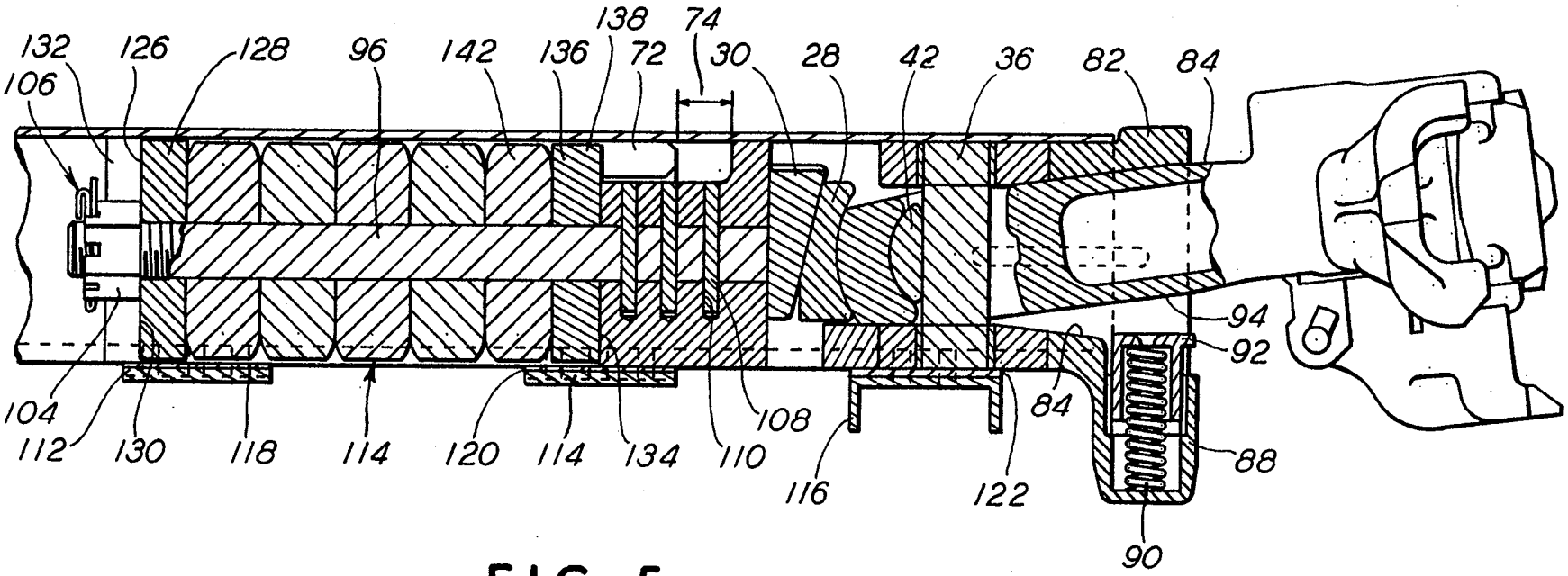
FIG. 5 is an elevational view of the slackless buff gear connection system of the invention shown in cross section and illustrated as it would appear when assembled to a coupler shank.

As seen in FIGS. 4 and 5 the front pocket portion 12 receives the butt end 26 of a coupler shank or drawbar and a follower 28 and slack take-up wedge 30. As is known in the art the proximate end 32 of the couple shank or drawbar is formed with a curved end surface 34 having a curvature concentric with the centers of the connecting pin 36 and of the bores 38 and 40 in the top wall portion 14 and bottom wall portion 16 respectively. This arrangement provides a slackless connection between the coupler shank or drawbar and the sliding yoke 10.

As seen in FIG. 4 the end of the coupler shank or drawbar is provided with inclined surfaces 46 and the side wall portions 18 and 20 of the front pocket portion 12 are each provided with inclined portion 48 to provide clearance to permit side to side angling of the coupler shank or drawbar when the railway car on which the connection is mounted negotiates a curve in the track.

As best seen in FIG. 1 the top and bottom portions 14 and 16 of the sliding yoke have inclined portions 50 to permit vertical angling of the drawbar or coupler shank when the train negotiates changes intrack elevation.

FIGS. 4 and 5 illustrate the slackless buff gear connection system of the invention assembled in one end of the center sill of a railway car.

Figure 9:
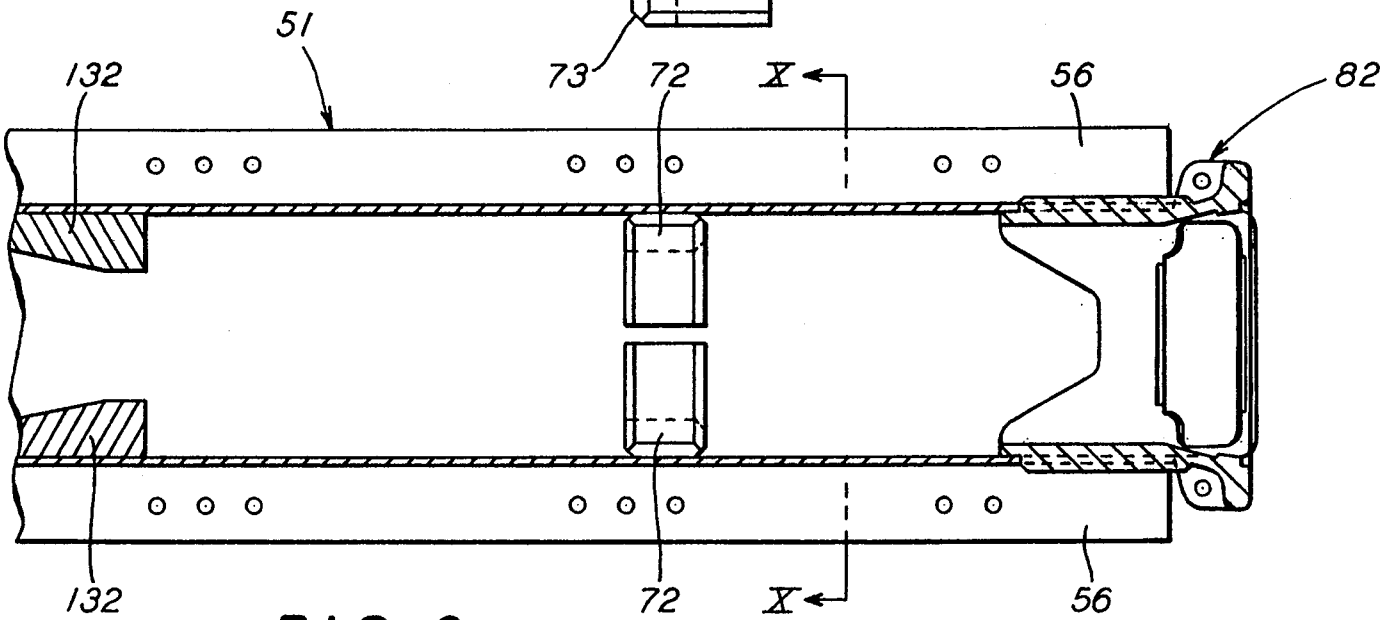
FIG. 9 is a schematic cross-sectional view of one end of a railway car center sill with the sill cap, sill load members and rear stops installed.

These drawings illustrate the type of center sill which comprises a top portion 52, a side wall 54 and a bottom flange 56. As shown in FIG. 9, the center sill of the railway car may be constructed from three separate plates indicated by the numerals 126, 128 and 130 welded or otherwise rigidly secured together. The center sill is also provided with flanges indicated by the numeral 56. The center sill may also be made from two Z-bars welded together in a manner well know in the art. Either form of construction produces a center sill of generally rectangular cross section, open at its bottom and having out-turned flanges on each side.

The sliding yoke of the invention further comprises a rear block portion 58. This rear block portion is of smaller width and height than the corresponding width and height of the front pocket portion of the sliding yoke, as may be seen in FIGS. 1 and 2, and has a rear wall surface 60. A bore 62 is formed in the rear block portion 58 through rear wall surface 60. Bore 62 extends along the longitudinal center line of the sliding yoke through at least a portion of the rear block portion. As will be described later the bore 62 may be made with internal threads 64. To reduce the weight of the sliding yoke but still maintain structural length, the lower portion of rear block portion 58 may be formed as a series of vertical walls or fins 59, best seen in FIGS. 1 and 3.

To assemble the connection system of the invention to the center sill of a railway car, the yoke 10 is assembled to the buff gear assembly 140 and the rear stop 132, sill load members 68, 69 and sill cap 82 are secured to the center sill. The sliding yoke and buff gear assembly are then inserted in the center sill through the bottom thereof and front buff gear support plate 114 and wear plate 120 are secured to the center sill. Then follower 28 and slack take up wedge 30 are placed in the front pocket portion 12 with wedge 30 supported in a raised position to provide clearance for maneuvering the coupler shank which is inserted through the sill cap. With the butt end of the coupler shank in proper position between top wall 14 and bottom wall 16, a connecting pin 36 is inserted through the bores 38 and 40 of the sliding yoke. Next connecting pin support plate 116 and wear plate 122 are placed underneath the yoke and connecting pin and secured to the flange 56 by bolts or other means to maintain the connecting pin in position in the yoke. Finally, rear buff gear support plate 112 and wear plate 118 are secured to flange 56 of the center sill. The buff gear 140 and sliding yoke 10 are thus supported within the center sill with the yoke being free to slide longitudinally within the center sill within the limits provided by other means which will now be described.

To facilitate assembly of the buff gear assembly 140 in the center sill between the sill load members 68, 69 and the rear stop 132, the elastomeric compression members 142 may be compressed more than required to attain the final prestress desired until the assembly is made and then the nut 104 loosened to the point of desired prestress.

To limit motion of the sliding yoke in a direction rearwardly from the front or open end of the railway car center sill, a pair of sill load members 68, 69 is provided. Each sill load member 68, 69 comprises a side member 70, rigidly secured to the inside of the center sill of a railway car in opposed parallel relation to each other and in a position where they overlie a portion of the length 74 of the rear block portion 58, of the sliding yoke. Each sill load member may also include a lateral top portion 72 integrally formed with or rigidly secured to its respective side member and extending toward but stopping short of the longitudinal center line of the car center sill. The side members 70 and top members 72 are rigidly secured, as by welding, to the adjacent inside surfaces of the car center sill.

The dimensions of the sill load members relative to the dimension of the rear block portion of the sliding yoke are selected to allow free sliding motion of rear block portion 58 in a longitudinal direction along the longitudinal center line of the railway car center sill for a predetermined distance 74 in the rearward direction before the end walls 76 of the sliding yoke contact the adjacent front wall 78 of the side members 70. The sliding yoke is prevented from sliding out of the free end 80 of the center sill by a sill cap 82 which is rigidly secured to the open end of the center sill by suitable means, such as welding, as can best be seen in FIG. 2. Sill cap 82 is provided with inclined surfaces 84 at the top and bottom to permit vertical angling of the coupler shank or drawbar. Sill cap 82 also has inclined surfaces 86 to permit horizontal angling of the coupler shank or drawbar. In addition, the lower portion of the sill cap 82 may be provided with a spring housing 88 for retaining one or more compression springs 90 which urge a coupler shank support 92 upwardly against the bottom surface 94 of the coupler shank or drawbar when the coupler shank or drawbar are in a substantially horizontal position to help support a portion of the weight of the drawbar or coupler shank. When required by changes of slope of the track, the coupler shank support can move downward against the pressure of springs 90 under the force of a coupler shank or drawbar.

As can be seen in FIGS. 4 and 5, a buff gear support rod 96, is secured to the rear block portion 58 of the sliding yoke by suitable means such as threads, shear pins or welding.

FIGS. 1 and 2 show buff gear support rod 96 secured by its threads 144 to the rear block portion 58 of the sliding yoke and threads 64 in bore 62 and a locking pin or set screw 146.

FIGS. 4 and 5 illustrate an alternative arrangement wherein buff gear support or rod 96 is secured to the rear block portion of the sliding yoke by a series of shear pins 124. As shown in the drawings, three shear pins are used but less or more than three shear pins may be employed for this purpose. In this arrangement the rod 96 has a shank portion 98 which is unthreaded but is provided with drilled holes 110 each, suitable for accepting a shear pin. The distal end of the rod is provided with threads 100 to accept a nut which holds the buff gear assembly on the buff gear support rod. The nut 104 may be of the castellated type, as shown in FIG. 5, in which case a hole 102 is drilled through the threaded portion of the rod to receive a cotter pin 106.

Figure 7:
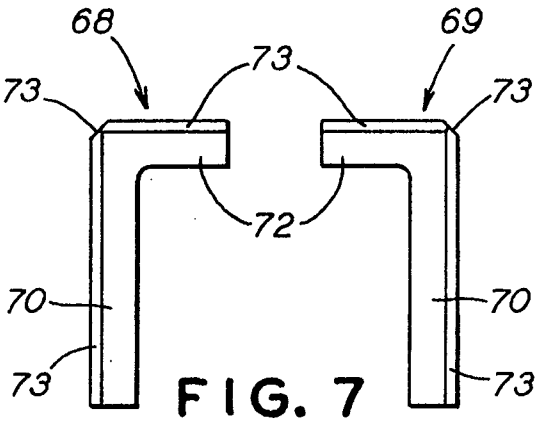
FIG. 7 is a front elevational view of a preferred form of sill load member.
Figure 6:
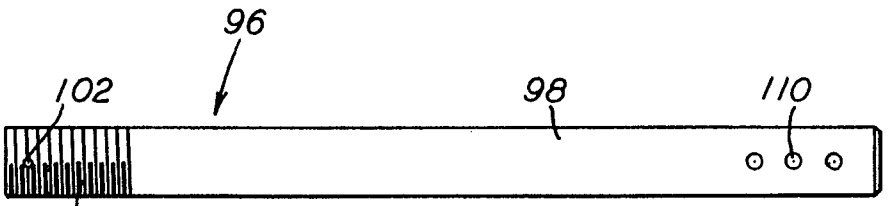
FIG. 6 illustrates one form of buff gear support rod which may be used in the invention.
Figure 8:
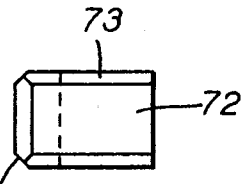
FIG. 8 is a top plan view of the sill load member of FIG. 7.

As seen in FIGS. 7 and 9, the sill load members 68 and 69 are provided with welding chamfers 73 to facilitate welding.

In addition to the threads or shear pins or as an alternative to the threaded or pin connection between the buff gear support rod 96 and rear block portion 58 of sliding yoke, the support rod may be welded to the rear support block. Except in cases where rod 96 is secured to rear block portion 58 by the threads, the bore 62 and the portion of rod 96 which fits within such bore may be of square or other angular shape.

Operation of the connection system of the invention will be described below. When the apparatus is at rest, that is no buff or draft loading applied to the coupler or drawbar, the buff gear apparatus is adjusted by turning the nut 104 in the tightening direction until the desired preload is applied to the buff gear. In this condition the rear face 126 of rear buff gear plate 128 will be in contact with the front face 130 of rear stop 132. The rear face 76 of front pocket portion of the sliding yoke will be spaced at its maximum distance from the front face 78 of the sill load members 68, 69. The front end 22 of yoke 10 will be in contact with sill cap 82. Draft loads will be applied through connecting pin 36, through yoke 10 to sill cap 82 to center sill 51.

Under buff loading in excess of the prestress load the elastomeric members of the buff gear will be compressed by the buff forces causing relative movement of the center sill with respect to the connecting pin 116 and sliding yoke 10. As buff forces increase, the buff gear will be compressed to the point at which the front face 78 of the sill load members 68 and 69 contacts the rear face 76 of the front pocket portion 12 of the sliding yoke. This determines the maximum buff load which will be absorbed by the buff gear 140. Buff loads in excess of that amount will be transferred directly from the center sill 51, through the sill load members 68 and 69 to the sliding yoke 10, and via the connecting pin 36 to the coupler shank or drawbar. As yoke 10 moves relative to the center sill in a direction inward from the open end 80 of the center sill, yoke 10 will also be spaced from contact with sill cap 82.

Assuming now that train operation will change from buff to draft, as the buff load decreases from its maximum the sliding yoke 10 will remain in contact with the sill load member 68 and 69 until the buff load decreases below the level of maximum load which can be absorbed by the buff gear. As the buff load reduces further, the elastomeric members in the buff gear assembly will expand until sliding yoke 10 contacts sill cap 82. Buff gear assembly 140 will be under the design prestress loading.

As buff load is further reduced it continues to be absorbed in the buff gear assembly until it reaches zero. As loading changes from buff to draft load, it is applied directly to the center sill through connecting pin 36, yoke 10 and sill cap 82. The prestress in buff gear assembly 140 prevents the occurrences of alternating buff and draft impact loads during in-track operation at a relatively constant speed.

As an example, the connection system of the invention may be made with a design prestress on the buff gear of 100,000 pounds and a maximum buff load absorption capacity of 650,000 pounds when the permissible relative motion 74 between the sliding yoke and the car center sill is three inches.

The sliding yoke 10 and buff gear support rod 96 may be cast, machined or fabricated.

While both the presently preferred and alternative embodiments of the invention have been shown and described in detail, it should be obvious that other modifications and adaptations of the invention can be made by persons skilled in the art without departing from the spirit of the invention and the scope of the appended claims.

I claim:

1. A railway car connection system for a railway car having a center sill with a predetermined interior cross section, said connection system including a sliding yoke, said sliding yoke comprising:

(a) a front pocket portion open at a front end thereof;

(b) a top wall portion forming a top of said front pocket portion;

(c) a bottom wall portion forming a bottom of said front pocket portion;

(d) a pair of radially opposed side wall portions forming each side of said front pocket portion;

(e) said top wall portion, said bottom wall portion and said side wall portions forming a continuous outer wall of said front pocket portion;

(f) said continuous outer wall having an outer cross section so as to be capable of being received in such center sill and capable of sliding within such center sill longitudinally thereof;

(g) said top wall portion having a first bore therethrough, said bore having a predetermined diameter;

(h) said bottom wall portion having a second bore therethrough having a predetermined diameter and concentric with said first bore;

(i) a rear block portion having a top wall portion, a bottom wall portion and side wall portions each adjacent said corresponding top wall portion, bottom wall portion and side wall portions of said front pocket portion and at least said side wall portions of said rear block portion being recessed inwardly toward a longitudinal center line of said sliding yoke from corresponding adjacent portions of said continuous outer wall of said front pocket portion such that at least the entire width of said rear block portion is less that the width of said front pocket portion; and (j) said rear block portion having a rear wall surface and being provided with a bore having its axis along said longitudinal centerline of said front pocket portion, said bore extending through said rear wall surface of said rear block portion and at least partly through said rear block portion.

2. A railway car connection system, as set forth in claim 1, wherein said bore in said rear block portion is internally threaded and said railway car connection system further includes a rod externally threaded on at least one of its ends with a thread engageable with threads on said bore to secure said rod to said sliding yoke.

3. A railway car connection system, as set forth in claim 2, further comprising at least one elastomeric member supported on said rod and encompassing it.

4. A railway car connection system, as set forth in claim 3, further comprising a front buff gear plate surrounding said rod and interposed between said at least one elastomeric member and said rear wall surface of said rear block portion of said sliding yoke.

5. A railway car connection system, as set forth in claim 4, further comprising a rear buff gear plate surrounding said rod and located on a side of said at least one elastomeric member opposite a side on said front buff gear plate is located.

6. A railway car connection system, as set forth in claim 5, further comprising adjustable means for moving said rear buff gear plate toward said front buff gear plate to thereby apply an adjustable predetermined resilient force between said rear buff gear plate and said rear wall surface of said rear block portion of said sliding yoke.

7. A railway car connection system, as set forth in claim 5, further comprising a rear stop adapted to be secured to such center sill longitudinally inward from a location of said sill stop to limit longitudinal motion of said rear buff gear plate in a direction away from a distal end of such center sill.

8. A railway car connection system, as set forth in claim 7, further comprising means for securing one end of a connection means extending between a pair of adjacent railway cars to said sliding yoke and for transferring draft and buff loads between cars through said connection means.

9. A railway car connection system, as set forth in claim 8, wherein at least a portion of impact forces produced in changing from draft to buff loading is absorbed by said elastomeric buff gear member.

10. A railway car connection system, as set forth in claim 9, wherein said adjustable means comprises threads on said rod and an internally threaded member abutting said rear buff gear plate on its side opposite a side adjacent said at least one elastomeric member.

11. A railway car connection system, as set forth in claim 3, wherein said at least one elastomeric member comprises a plurality of elastomeric members.

12. A sliding yoke according to claim 1 wherein said sliding yoke comprises a one piece casting.

13. A sliding yoke casting, as set forth in claim 12, further comprising a rear wall in said front pocket portion, and a distance between said first and second bores and said rear wall in said front pocket portion being sufficient to permit insertion of a follower and a slack take-up wedge between said rear wall and the adjacent end of such railway car connection means to provide a slackless connection between said sliding yoke and said railway car connection means.

14. A railway car connection system for use in a railway car having a center sill with a predetermined interior cross section, said connection system comprising:

(a) a sliding yoke having a rear block portion at its rear end and a front pocket portion open at its front end, said front pocket portion being formed by a continuous outer wall;

(b) said continuous outer wall having an outer cross-section so as to be and capable of being received in such center sill for sliding movement within such center sill longitudinally thereof;

(c) said rear block portion having an outer cross-section smaller than said outer cross-section of said continuous outer wall of said front pocket portion at least in the width dimension such that at least two radially opposed partial wall members are formed at an interface between said front pocket portion and said rear portion transverse to said continuous outer wall of said front pocket portion;

(d) a sill load member including at least first and second radially opposed stop members capable of being secured to such center sill; so as to engage said radially opposed partial wall members formed at said interface between said front pocket portion and said rear portion to limit longitudinal movement of said sliding yoke in a direction away from a distal end of such center sill.

15. A railway car connection system for use in a railway car having a center sill with a predetermined interior cross section, said connection system comprising:

(a) a sliding yoke having a rear block portion at its rear end and a front pocket portion open at its front end, said front pocket portion being formed by a continuous outer wall;

(b) said continuous outer wall having an outer cross-section so as to be capable of being received in such center sill for sliding movement within such center sill longitudinally thereof;

(c) a sill cap adapted to be secured to such center sill in which said sliding yoke has been placed to thereby engage a forward edge of said continuous outer wall to limit longitudinal movement of said sliding yoke toward an open end of such center sill;

(d) a front pocket portion having a top wall portion, a bottom wall portion, and a pair of side wall portions so as to form a continuous outer wall of said front pocket portion;

(e) a rear block portion having a top wall portion, a bottom wall portion and side wall portions each adjacent said corresponding top wall portion, bottom wall portion and side wall portions of said front pocket portion and at least said side wall portions of said rear block portion being recessed inwardly toward a longitudinal centerline of said sliding yoke from corresponding adjacent portions of said continuous outer wall of said front pocket portion such that at least the entire width of said rear block portion is less than the width of said front pocket portion.

16. A railway car connection system for use in a railway car having a center sill with predetermined interior cross section, said connection system comprising:

(a) a sliding yoke having a rear block portion at its rear end and a front pocket portion open at its front end, said front pocket portion being formed by a continuous outer wall;

(b) said continuous outer wall having an outer cross-section so as to be capable of being received in such center sill for sliding movement within such center sill longitudinally thereof;

(c) a sill load member including at least first and second radially opposed stop members capable of being secured to such center sill so as to limit longitudinal movement of said sliding yoke in a direction away from a distal end of such center sill; and (d) a sill cap adapted to be secured to such center sill in which said sliding yoke has been placed to thereby engage a forward edge of said continuous outer wall to limit longitudinal movement of said sliding yoke toward open end of such center sill.

17. A railway car connection system, as set forth in claim 16, wherein said sill load stop includes an outer wall substantially congruous with an outer wall of said sliding yoke.

18. A railway car connection system, as set forth in claim 17, wherein said sill load stop is provided with a central through opening having an inner cross section complementary to and of greater dimension than an outer cross section of said rear block portion of said sliding yoke, whereby said rear block portion may freely slide through said sill load member in a direction along a longitudinal centerline of such center sill.

19. A railway car connection system, as set forth in claim 18, wherein a length of said outer wall of said front pocket portion of said sliding yoke measured in a direction along said longitudinal centerline of said sliding yoke is less than a distance between opposing adjacent surfaces of said sill cap and said sill load member secured to such railway car center sill.

20. A railway car connection system, as set forth in claim 19, wherein said length of said rear block portion of said sliding yoke measured along said longitudinal centerline of said sliding yoke is greater than a corresponding dimension of said sill load member whereby said rear block portion will remain in positive contact with an adjacent surface of a front buff gear plate adapted to be secured to such center sill during any sliding movement of said sliding yoke between said sill load member and said sill cap.

* * * * *

UNITED STATES PATENT AND TRADEMARK OFFICE

CERTIFICATE OF CORRECTION

PATENT NO. : 5,360,124

DATED : November 1, 1994

INVENTOR(S) : Jeffrey D. Wurzer et al.

It is certified that error appears in the above-indentified patent and that said Letters Patent is hereby corrected as shown below:

Column 10, line 25, delete ";" after sill.

Column 12, line 13, delete "railway car" after such.

Signed and Sealed this

Seventh Day of February, 1995

*Attest:*

Bruce Lehman

BRUCE LEHMAN

*Attesting Officer*

*Commissioner of Patents and Trademarks*